US005216847A

United States Patent [19]

Scheider et al.

[11] Patent Number: 5,216,847

[45] Date of Patent: * Jun. 8, 1993

[54] ABRASIVE FILAMENT HONING TOOL AND METHOD OF MAKING AND USING SAME

[75] Inventors: Alfred A. Scheider, Orange; R. Brown Warner, Westlake, both of Ohio

[73] Assignee: Jason, Inc., Cleveland, Ohio

[ * ] Notice: The portion of the term of this patent subsequent to Jul. 14, 2009 has been disclaimed.

[21] Appl. No.: 508,060

[22] Filed: Apr. 11, 1990

Related U.S. Application Data

[63] Continuation-in-part of Ser. No. 228,438, Aug. 5, 1988, Pat. No. 5,129,191.

[51] Int. Cl.[5] ..... B24D 9/00

[52] U.S. Cl. ..... 51/330; 51/334; 51/338

[58] Field of Search ..... 51/330, 334, 336, 337, 51/338, 349, 180 NT; 300/21

[56] References Cited

U.S. PATENT DOCUMENTS

| | | | |
|---|---|---|---|
| 2,049,324 | 7/1936 | Schneider | 51/337 |
| 2,488,873 | 11/1949 | Maynard | 300/21 |
| 3,798,699 | 3/1974 | Lewis, Jr. | 300/21 |
| 4,635,313 | 1/1987 | Fassler et al. | 300/21 |

FOREIGN PATENT DOCUMENTS

| | | | |
|---|---|---|---|
| 3719796 | 12/1988 | Fed. Rep. of Germany | 51/334 |

*Primary Examiner*—M. Rachuba

*Attorney, Agent, or Firm*—Renner, Otto, Boisselle & Sklar

[57] ABSTRACT

A honing tool characterized by an elongated rectangular cup element or holder having a bottom interior surface, a bundle of closely packed relatively short discrete generally parallel filaments secured in the holder, and a thin layer of instant adhesive securing substantially all of the filaments at one end face of the bundle to the bottom interior surface of the holder. To make such a honing tool, a measured bundle of uniformly closely packed nonwoven, generally parallel discrete filaments is formed. A holder is supported and a measured amount of liquid adhesive is placed in the bottom interior of the holder so that a thin layer of such adhesive completely covers the bottom of the interior of the holder. The bundle is then promptly driven into the holder so that all of the filaments at one end of the bundle are in contact with the adhesive prior to the curing of the adhesive. The adhesive is then cured whereby the one end face of the bundle is secured to the bottom interior of the holder.

43 Claims, 3 Drawing Sheets

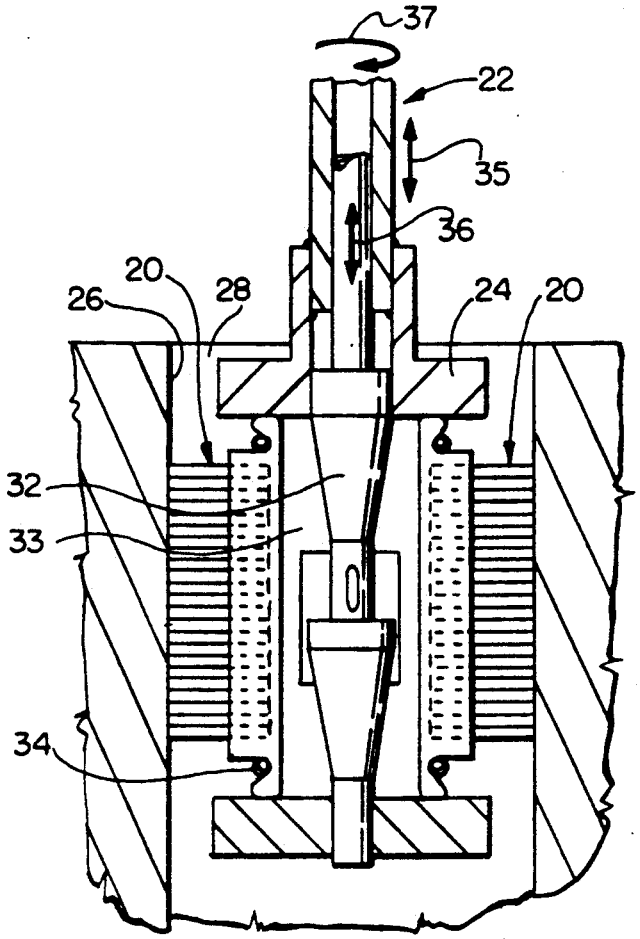
FIG. 1
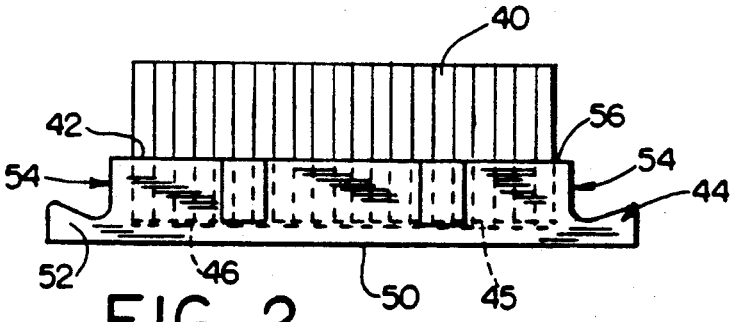
FIG. 2
FIG. 3
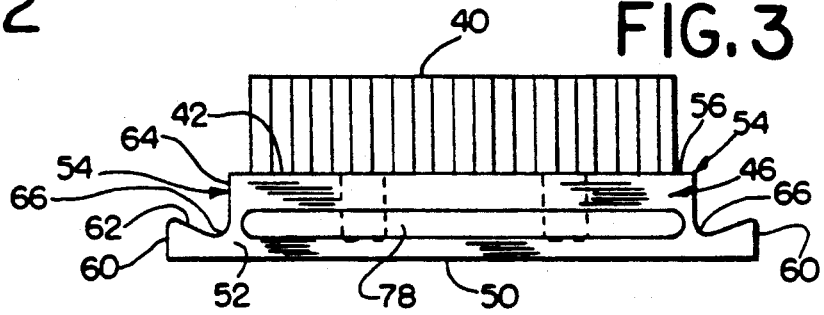

ABRASIVE FILAMENT HONING TOOL AND METHOD OF MAKING AND USING SAME

RELATED APPLICATION

This application is a continuation-in-part of applicants' co-pending application entitled "Adhesive Bonded Flexible Abrasive Finishing Tool", Ser. No. 228,438, filed Aug. 5, 1988, now U.S. Pat. No. 5,129,191, printed Jul. 14, 1992 the entire disclosure of which is hereby incorporated by reference.

This invention relates generally as indicated to an abrasive filament honing tool including a method of making and using the same, and more particularly to a honing tool including a bundle of discrete filaments which affords better chip clearance and surface finish.

BACKGROUND OF THE INVENTION

A honing machine is commonly used for finishing a bore in a workpiece. When a workpiece, such as a cylinder, is bored out, the boring tool leaves V-shaped grooves in the surface of the cylinder wall, much like those on a phonograph record. The sharp peaks of these have to be rounded off by finish honing the bore. The typical honing machine uses a set of honing tools spaced around a machine body and fed progressively outwardly into a generally cylindrical internal wall of a workpiece while the machine body is simultaneously rotated within and reciprocated along the workpiece. In this manner, the working face of each honing tool is forced into engagement with the wall under selected honing pressure to abrade and finish the wall.

The specific honing tools usually include a honing element secured in a holder. This honing element is commonly a one-piece element, and in fact is usually referred to as a "honing stone". Examples of such honing elements are described in prior U.S. Pat. Nos. 3,829,299; 2,980,524; 3,352,067; 3,154,893; 3,132,451; 4,528,776; 4,555,875; 3,972,161 and 3,918,218. In the latter two patents, a plurality of cutting filaments are embedded in a matrix, however the resulting honing element is nonetheless a one-piece relatively rigid element.

In the course of honing, it is common for chips or burns to be knocked loose from the cylinder. Because of the solid structure of most honing elements, no clearance is present between the wall and the working face of the honing element. These chips may wedge themselves between the working face of the honing element and the wall. Although a liquid is usually flushed through the bore during honing, such has little effect on the wedged chips. Eventually, either the wall or the honing element must give, resulting in the damage of a honing element or stone and/or the scarring of a bore of what may be an expensive cylinder.

Also many bores such as engine bores have lateral ports. Conventional honing stones or tools cannot radius or finish the edges of such ports. Thus a need remains for an improved honing tool providing improved surface finish.

SUMMARY OF THE INVENTION

The present invention provides a honing tool which affords better chip clearance and an improved surface finish by using a bundle of discrete filaments as its honing element. The honing tool includes a cup element in the form of a rectangular holder having a bottom interior surface, a bundle of closely packed discrete generally parallel filaments secured in the holder, and a thin layer of instant adhesive securing substantially all of the filaments at one end face of the bundle to the bottom interior surface of the holder.

To make such a honing tool, a measured bundle of uniformly closely packed nonwoven, generally parallel discrete filaments is formed. A cup element or holder is supported and a measured amount of liquid adhesive is placed in the bottom interior of the cup element so that a thin layer of such adhesive completely covers the bottom of the interior of the cup element. The bundle is then promptly driven into the cup element so that all of the filaments at one end of the bundle are in contact with the adhesive prior to the curing of the adhesive. The adhesive is then cured whereby the one end face of the bundle is secured to the bottom interior of the cup element or holder.

In one embodiment a bundle of relatively short filaments is cut to length and formed before being driven into the holder and the adhesive. In another embodiment a bundle of longer filaments is driven through a shaping die into the holder and adhesive and then cut to length.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In the annexed drawings:

FIG. 1 is a fragmentary side elevation of an abrasive filament honing tool according to the present invention employed in a honing machine, parts of the machine and the associated workpiece being shown in cross-section;

FIG. 2 is a front view of a honing tool which employs filaments of a rectangular transverse cross-section;

FIG. 3 is a rear view of the honing tool but showing a modified holder;

DETAILED DESCRIPTION OF THE PREFERRED EMBODIMENTS

Figure 4:
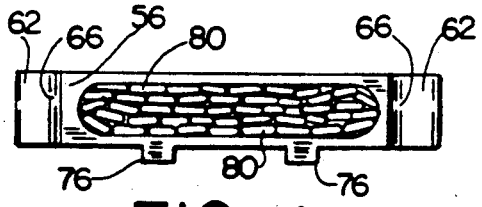
FIG. 4 is a top view of the honing tool of FIG. 2.

Referring now to the drawings in detail and initially to FIG. 1, a honing tool 20 according to the present invention is shown installed in a typical honing machine 22. The honing machine 22 uses a set of honing tools spaced around a machine body 24 and fed progressively outwardly into a generally cylindrical internal wall 26 of the bore 28 of a workpiece 30. The tool body 24 includes a wedge cone 32 and a follower 33 for each honing tool 20. The honing tools 20 and followers 33 are assembled to the machine body 24 by garter springs 34. In operation, the machine body 24 is moved axially into the bore 28 as indicated schematically by arrow 35. The wedge cones 32 are reciprocated as shown by arrow 36 to radially expand and contract the honing tools 20, thereby maintaining the outer working face of each honing tool 20 in engagement with the wall 26 under selected honing pressure. Simultaneously, the machine body 24 is rotated within the bore 28 as indicated by arrow 37 thereby abrading and finishing the wall 26.

Referring now additionally to FIGS. 2–6, the honing tool 20 is shown in detail. The honing tool 20 comprises a relatively short bundle 40 of plastic abrasive loaded filaments or monofilaments and a rectangular cup element 42 which is an integral part of a holder 44. The bundle 40 is bonded to the bottom surface or wall 45 of the cup element 42 by a liquid instant adhesive seen at 46.

The holder 44 is roughly rectangular in section its length being at least twice its width. It may be formed of metal or of a non-brittle plastic such as nylon. The holder 44 includes a flat bottom wall 50, two side walls 52, two end walls 54 and a top wall 56. The side walls 52 are generally straight and connect the top wall 50 to the bottom wall 56. The end walls 54 are curved and include outer straight section 60 adjacent to the bottom surface, an inwardly and downwardly sloped section 62, adjacent straight section 60 and an inner straight section 64 adjacent the section 62. The sections 62 and 64 together form an inner corner 66, which may serve as resting point for a garter spring, such as the garter spring 34 shown in FIG. 1.

The top wall 56 is the same width but is not as long as the bottom wall 50. As indicated above, the cup element 42 is an integral part of the holder 44. Specifically, the cup element extends downward from the top wall 56 extending a substantial portion of the height of the holder, but terminating short of the bottom wall 50. The cup element 42 has two flat sides 70 connected by two rounded corners 72, the sides and corners together forming an oblong opening 73. One side wall 52 includes two spacers 76. In the holder shown in FIG. 3, the opposite side wall 52 may include a slot 78 through which instant adhesive in a gel form may be injected.

Figure 7:
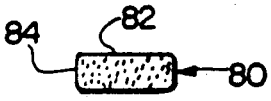
FIG. 7 is an enlarged transverse section of a rectangular filament.

The bundle 40 may comprise plastic abrasive loaded filaments or monofilaments 80 having a rectangular transverse cross-section as shown in FIG. 4. An enlarged view of the transverse cross-section is shown in FIG. 7 and, as shown, the filament has a width 82 and a thickness 84. Such monofilaments are described in more detail in applicants' copending application entitled "Rotary Abrasive Tool and Filament Therefor", Ser. No. 216,710, filed Jun. 8, 1988, the entire disclosure of which is hereby incorporated by reference.

Typically, the rectangular filament 80 at its major flat face may be approximately 0.090 inch wide and about 0.045 inch thick. Somewhat wider rectangular filaments may be employed having major flat faces up to three to four times the thickness of the filament. The width is preferably not greater than four times the thickness, more preferably the width is not greater than three times the thickness and still more preferably the width is approximately twice the thickness. The length of the monofilament, projecting from the holder, is at least ten times greater than the width, and more preferably at least twenty times greater than the width. The projection form the holder is nonetheless relatively short.

The monofilament may be extruded plastic impregnated throughout uniformly with an abrasive mineral such as aluminum oxide or silicon carbide. Other more exotic abrasive minerals may readily be employed such as polycrystalline diamond. Also, the abrasive grit size may be varied from coarse to fine powders for extra fine polishing and highlighting effects on work parts.

The plastic material preferably has a Young's modulus greater than 0.10 at $10^6$ psi and more preferably greater than 0.40 at $10^6$ psi. Young's modulus is defined as the amount of force a material can undergo without permanent deformation when the force is removed. This is a measure of elasticity or the relationship of stress over strain.

The preferred plastic for extrusion of the monofilament working element is nylon. The preferred nylon is 6/12 nylon. Nylons are long-chain partially crystalline synthetic polymeric amides (polyamides). Polyamides are formed primarily by condensation reactions of diamines and dibasic acids or a material having both the acid and amine functionality.

Nylons have excellent resistance to oils and greases, in solvents and bases. Nylons have superior performance against repeated impact, abrasion, and fatigue. Other physical properties include a low coefficient of friction, high tensile strength, and toughness. Useful mechanical properties of nylon include strength, stiffness and toughness. In general, the greater the amount of amide linkages, the greater the stiffness, the higher the tensile strength, and the higher the melting point. Several useful forms of nylon are available and include:

A. Nylon 6/6 synthesized from hexamethylenediamine (HMD) and adipic acid;
B. Nylon 6/9 synthesized from HMD and azelaic acid;
C. Nylon 6/10 synthesized from HMD and sebacic acid;
D. Nylon 6/12 synthesized from HMD and dodecanedioic acid;
E. Nylon 6 synthesized from polycaprolactam;
F. Nylon 11 synthesized from 11-aminoundecanoic acid;
G. Nylon 12 synthesized from polyaurolactam; and others.

Nylons useful in the present invention have a Young's modulus greater than 0.05, preferably greater than 0.1 and preferably greater than 0.2.

The preferred nylon is nylon 6/12. The physical properties of nylon 6/12 include a melting point of 212° C., a dry yield strength at $10^3$ psi of 8.8 (7.4 at 50% RH), a dry flexural modulus of 295 (180 at 50% RH). Nylon has a higher Young's modulus (0.40 at $10^6$ psi) than rubber (0.01 at $10^6$ psi), which demonstrates the greater stiffness of nylon over an elastomer such as rubber, for example. As an example, a working element according to the present invention several feet long when held horizontally at one end at room temperature would show little or minimal deflection at the opposite end.

Nylon is partially crystalline, hence has little or no rubbery regions during deformation. The degree of crystallinity determines the stiffness and yield point. As the crystallinity decreases the stiffness and yield stress decreases. Rubber, on the other hand, is an amorphous polymer and its molecular straightening leads to a low modulus of elasticity.

Nylon has a tensile strength of over 8000 psi, rubber has a tensile strength of 300 psi. Nylon exhibits 250% breakage during elongation, rubber exhibits 1200%. Nylon has fair moisture resistance, yet rubber absorbs a large amount of water. Nylon has excellent resistance to oil and greases and other organic solvents, rubber has extremely poor resistance. Nylon retains its properties from −75° F. to 230° F., while rubber has a narrow range around room temperature. Nylon's increased strength, resistance to moisture and solvents, and its wide usable temperature range make it the preferred material for this construction.

Another type of polyamide useful in the present invention include other condensation products with recurring amide groups along the polymer chain, such as aramids. Aramids are defined as a manufactured fiber in which at least 85% of the amide (—C(O)—N(H)—) linkages are attached directly to two aromatic hydrocarbon rings. this is distinguished from nylon which has less than 85% of the amide linkages attached directly to the two aromatic rings.

The plastic material may also be aramid fibers which are characterized by high tensile strength and high modulus. Two Aramids that may be useful in the present invention include fiber formed from the polymerization of p-phenylenediamine with terephthaloyl chloride and a less stiff polymer formed from the polymerization of m-phenylenediamine and isophthaloyl chloride.

Aramids demonstrate a very strong resistance to solvents. Aramids have tensile strengths at 250° C. that are exhibited by textile fibers at room temperature.

Also, some thermoset polymers are useful. Polyesters are an example and are long chain synthetic polymers with at least 85% of a dihydric alcohol ester (HOROH) and terephthalic acid (p-$HOOCC_6H_4COOH$). Polyester fibers contain both crystalline and non-crystalline regions. Polyesters are resistant to solvents and demonstrate a breaking elongation of 19 to 40%.

Polyimides are polymers containing (CONHCO) and are also useful in the present invention. High temperature stability (up to 700° F.) and high tensile strength of 13,500 psi make polyimides useful as binders in abrasive wheels.

Figure 5:
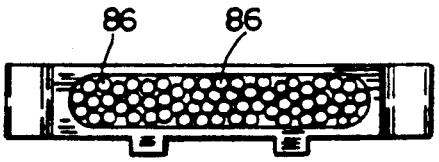
FIG. 5 is a top view of a honing tool which uses filaments of a circular transverse cross-section.
Figure 6:
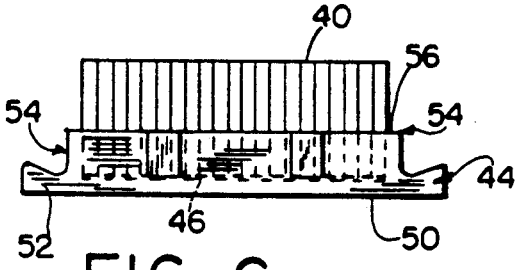
FIG. 6 is a front view of the honing tool of FIG. 5.
Figure 8:
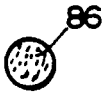
FIG. 8 is an enlarged transverse section of a circular filament.
Figure 9:
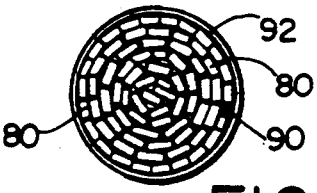
FIG. 9 is a top view of a cylindrical bundle of filaments.
Figure 10:
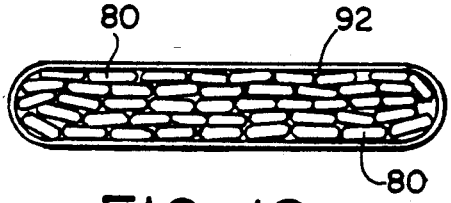
FIG. 10 is a top view of the bundle of FIG. 9 after being transformed into an oblong bundle.
Figure 11:
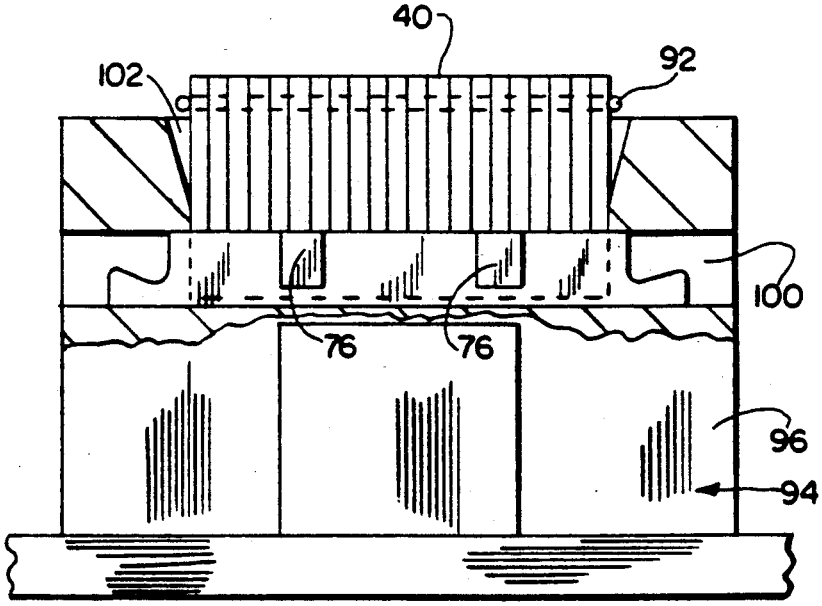
FIG. 11 is a front view of a support jig useful in making a honing tool according to the present invention.
Figure 12:
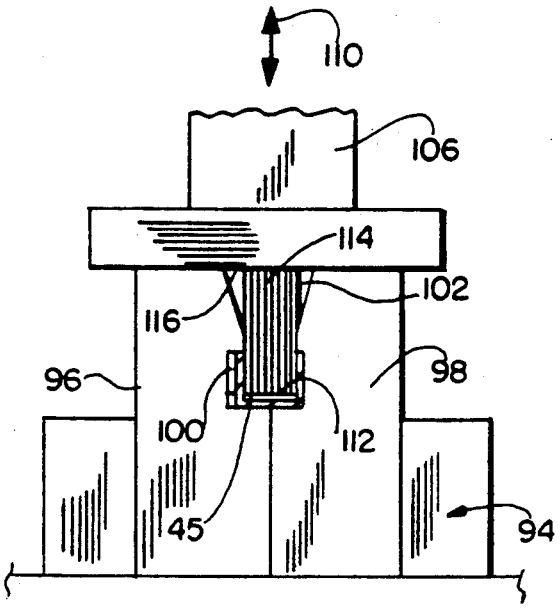
FIG. 12 is a side view of the support jig of FIG. 11 and also a pusher plate.

Alternatively, the bundle 40 may comprise filaments 86 having a circular transverse cross-section as is shown in FIG. 5. An enlargement of the transverse cross-section of this filament is shown in FIG. 8. The length of monofilament 86, projecting from the holder, is at least ten times greater than the diameter of the cross-section, and more preferably at least twenty times greater than its diameter. Again the length of the projection is nonetheless relatively short. The filament 86 may be made of the same materials discussed above in reference to filament 80.

Turning now to FIGS. 9–13, various steps in making a honing tool 10 are illustrated. Although the method is discussed in reference to rectangular filaments 80, a similar method would be used with circular in section filaments 86 and for that matter filaments of other shapes. In making the tool, first a plurality of discrete filaments 80 cut to the same relatively short length are preassembled into a cylindrical bundle 90. After the bundle 90 is preassembled, it may be temporarily held in shape by an elastic or rubber band 92. (See FIG. 9). The holder 44 is supported in a stationary jig 94, which includes two almost symmetrical parts 96 and 98. The parts 96 and 98 when brought together form a rectangular chamber 100 surrounding the holder 44. Specifically, the chamber 100 surrounds the bottom wall 50, the side walls 52, and also the outer edges of the top wall 56, while leaving the cup element 42 exposed. Part 96 has extra clearance to accommodate the spacers 76. The parts also form a funnel 102 above the chamber 100. (See FIG. 12).

A metered amount of liquid adhesive 46 is then placed in the bottom of the cup element 42. The adhesive may be inserted through the top of the cup element 42. Alternatively, it may be injected through the slot 78 if the holder of FIG. 3 is employed. As a liquid instant adhesive, it is preferred to employ a cyanoacrylate of low viscosity or high fluidity. It is important that when the adhesive is applied to the bottom wall 45 of the cup element 42 that it uniformly cover that wall.

Useful with the present invention are alkyl cyanoacrylates having the formula:

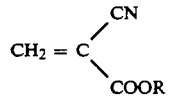

$R = CH_3$, $C_2H_5$, $C_3H_7$ etc.

A preferred cyanoacrylate adhesive is an alkoxy alkyl cyanoacrylate having the formula:

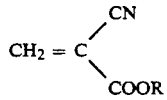

$R = CH_3—O—C_2H_5$, $C_2H_5—O—C_2H_5$

Suitable adhesives are available from Loctite Corporation of Newington, Conn. under the trademark SUPERBONDER ® 495, surface insensitive 454 gel, or the trademark BLACK MAX. SUPERBONDER is a registered trademark of Loctite Corporation. BLACK MAX is also a trademark of Loctite Corporation.

The cylindrical bundle 90 may be formed into an oblong shape, manually or otherwise, roughly matching the contour of the cup element 42. (See FIG. 10). Because the band 92 is elastic or rubber, it may remain on the bundle during this transformation. The transformed oblong bundle 90 of monofilaments 80 is then placed within the funnel 102 and driven downwardly by a pusher plate 106 driven by a suitable linear actuator such as seen schematically by arrow 110. In this manner, the end face 112 of the bundle 90 is driven into the liquid adhesive 45 which quickly sets bonding each monofilament 80 of the bundle 90 to the bottom wall 45 of the element 42. Because of the low viscosity of the adhesive 45 some of the adhesive will penetrate between the monofilaments 80 at the end face 112 bonding the inner end of each monofilament to adjacent monofilaments. The opposite end 114 of the bundle then may become the working face of the tool without subsequent trimming. The flat working surface 116 of the pusher plate 106 results in a flat working face of the tool.

A suitable pressure limit may retract the pressure plate 106. The completed honing tool may then be removed from the support jig 94, and installed, for example, on honing machine 22.

Figure 15:
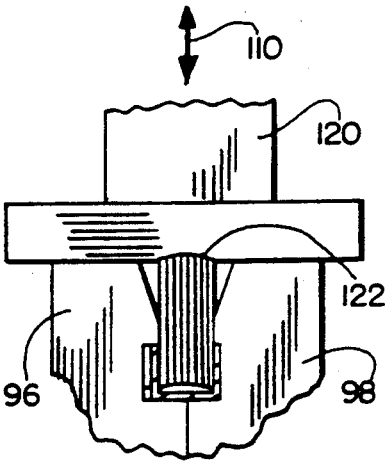
FIG. 15 is a side view of an assembly similar to that of FIG. 12 but using another type of pusher plate to impart a radius to the tool face.
Figure 14:
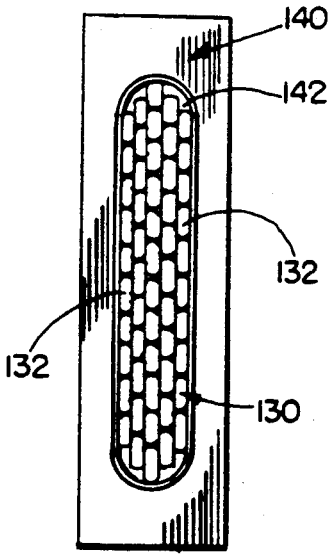
FIG. 14 is a view of the die as seen along line 14—14 in FIG. 13.

Instead of using a pusher plate with a flat working surface, a pusher plate 120 having a convex working surface 122 may be used. (See FIG. 15). When such a pusher plate is used to drive the bundle 90 into the liquid adhesive 45, the resulting end face 124 of the tool is provided with a radius which may correspond to the radius of the bore being honed. Monofilaments 80 of the same length are used, the curved end face 124 being the result of the bonding pattern of the filaments 80 to the bottom of the cup element 42.

The method of manufacture discussed above permits the formation of a honing tool 20 with a finished tool face without a final costly trimming operation. Obviously, the more exotic the abrasive material employed such as polycrystalline diamond, the more costly will be the trimming operation. Without the trimming operation there is no waste of such expensive fill materials. With the present invention the materials are cut one time and pressed into the cup element. Any unevenness is buried inside the cup element and is held firmly by the instant adhesive.

Figure 13:
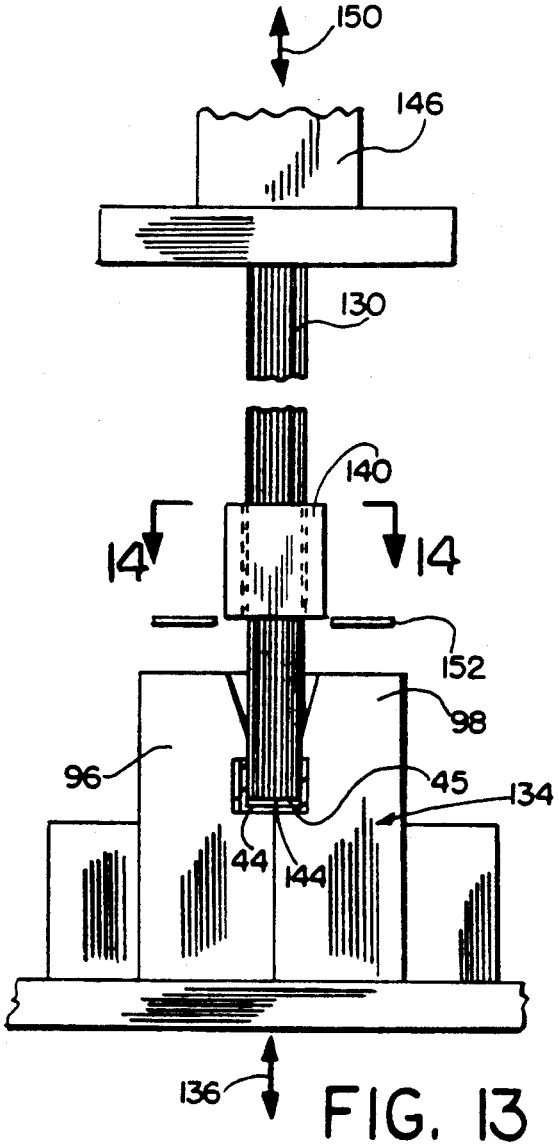
FIG. 13 illustrates an alternative method of assembling a honing tool according to the present invention which employs a shaping die and longer filaments.

Another method of making a honing tool according to the present invention is shown in FIG. 13. In this method, a bundle 130 of monofilaments 132 is preassembled. The monofilaments 132 are preferably of the same length, but are substantially longer than the monofilaments 80 used in the methods described above. For example, for making a tool with an inch or so trim, monofilaments several feet long may be used. The holder 44 is supported in a jig 134, which is similar to the jig 94 except that instead of being stationary, the jig 134 may be moved up and down by a suitable linear actuator as seen schematically by arrow 136.

An intermediate portion of the bundle 130 is inserted through a die 140 which has a hollow center 142 of a contour matching the cup element 42. In this manner, the monofilaments 132 may be neatly and compactly aligned. The bundle 130 is then positioned so that its lower end face 144 is aligned with the cup element 42.

A metered amount of liquid adhesive 45 is then placed in the bottom of the cup element 42, either through the top opening or side slot 78. The jig 134 may be moved up and fixed. Almost simultaneously, a pusher plate 146 is indexed downward by a suitable linear actuator illustrated schematically as arrow 150 to cause the end face 144 to engage the adhesive. The liquid adhesive 45 quickly sets bonding the end face 144 to the bottom wall of the cup element 42. The bundle 130 is then cut at a height indicated by cutting blades 152 in FIG. 13 adjacent the die. This cut end then becomes the working face of the honing tool.

It can now be appreciated that there is provided a simple and easily constructed abrasive filament honing tool. Because the honing element is composed of discrete filaments, the tool affords better chip clearance and surface finish.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A method of making a honing tool comprising the steps of:

forming a measured bundle of uniformly closely packed nonwoven, generally parallel discrete filaments;

supporting a cup element having a bottom surface;

placing a measured amount of instant adhesive in the interior of said cup element so that a thin layer of such adhesive completely covers the bottom surface of the cup element;

promptly driving such bundle into the cup element so that all of the filaments at one end of the bundle are in contact with the adhesive, prior to the curing of the adhesive; and curing the adhesive whereby the one end face of the bundle is secured to the bottom surface of the cup element.

2. A method as set forth in claim 1 wherein the cup element includes two flat sides and two rounded corners connecting the flat sides; the sides and corners together defining an oblong opening.

3. A method as set forth in claim 2 wherein the cup element is an integral part of a holder; the holder being substantially rectangular in section and its length being at least twice its width.

4. A method as set forth in claim 3 wherein the holder includes a slot communicating with the oblong opening and said placing step includes injecting the adhesive through the slot.

5. A method as set forth in claim 4 wherein said driving step includes positioning a pusher plate having a flat working surface adjacent to the bundle whereby the flat working surface is substantially parallel with an opposite end of the bundle.

6. A method as set forth in claim 4 wherein said driving step includes positioning a pusher plate having a convex working surface adjacent to the bundle whereby the tool working face is provided with a radius.

7. A method as set forth in claim 4 further including the step of inserting the bundle through a die having a hollow center of approximately the same contour as the cup element.

8. A method as set forth in claim 7 further including the step of trimming the bundle after said curing step.

9. A method as set forth in claim 4 wherein the instant adhesive is a cyanoacrylate.

10. A method as set forth in claim 9 wherein the adhesive is an alkyl cyanoacrylate.

11. A method as set forth in claim 9 wherein the adhesive is an alkoxy alkyl cyanoacrylate.

12. A method as set forth in claim 9 wherein the adhesive in its uncured form has a low viscosity.

13. A method as set forth in claim 4 wherein the holder is plastic.

14. A method as set forth in claim 4 wherein the holder is metal.

15. A method as set forth in claim 4 wherein the filaments are abrasive loaded nylon.

16. A method as set forth in claim 4 wherein the filaments are round in transverse cross-section.

17. A method as set forth in claim 4 wherein the filaments are a polygon in transverse cross-section.

18. A method as set forth in claim 4 wherein the filaments are rectangular in transverse cross-section.

19. A method as set forth in claim 18 wherein the filaments contain about 45% by weight of abrasive mineral.

20. A method as set forth in claim 4 wherein the bundle is formed by a plurality of filaments each cut to the same length.

21. A method as set forth in claim 4 wherein the filaments are made of a plastic selected from a group consisting of nylons, polypropylenes, aramids and polyesters.

22. A honing tool comprising:

a cup element having a bottom interior surface;

a bundle of closely packed discrete generally parallel filaments secured in said cup element; and a thin layer of instant adhesive securing substantially all of the filaments at one end face of the bundle to the bottom interior surface of the cup element.

23. A tool as set forth in claim 22 wherein said cup element includes two flat sides and two rounded corners connecting said flat sides; said sides and said corners together defining an oblong opening.

24. A tool as set forth in claim 23 wherein said cup element is an integral part of a holder; said holder being roughly rectangular in section and its length being at least twice its width.

25. A tool as set forth in claim 24 wherein said holder includes a slot communicating with said oblong opening whereby said adhesive may be injected through said slot.

26. A tool as set forth in claim 25 wherein said bundle has an opposite working end face in which said filaments form a flat working surface.

27. A tool as set forth in claim 25 wherein said bundle has an opposite working end face in which the filaments form a convex working surface.

28. A tool as set forth in claim 25 wherein said adhesive is cyanoacrylate.

29. A tool as set forth in claim 28 wherein said adhesive is an alkyl cyanoacrylate.

30. A tool as set forth in claim 29 wherein said adhesive is an alkoxy alkyl cyanoacrylate.

31. A tool as set forth in claim 25 wherein said holder is plastic.

32. A tool as set forth in claim 25 wherein said holder is metal.

33. A tool as set forth in claim 25 wherein said bundle of filaments is comprised of filaments of uniform length.

34. A tool as set forth in claim 25 wherein said filaments are made of a plastic selected from a group consisting of nylons, polypropylenes, aramids and polyesters.

35. A tool as set forth in claim 25 wherein said filaments are round in transverse cross-section.

36. A tool as set forth in claim 25 wherein said filaments are a polygon in transverse cross-section.

37. A tool as set forth in claim 25 wherein said filaments are rectangular in transverse cross-section.

38. A tool as set forth in claim 25 wherein said filaments contain about 45% by weight of abrasive mineral.

39. A tool as set forth in claim 25 wherein said bundle of filaments is of the same uniform density and orientation within the cup element.

40. A tool as set forth in claim 25 wherein said filaments are about 30% by weight loaded with mineral abrasive.

41. A method of making a honing tool including a cup element having a bottom interior surface, a bundle of closely packed discrete generally parallel filaments secured in the cup element, and a thin layer of instant adhesive securing substantially all the filaments at one end face of the bundle to the bottom interior surface of the cup element; said method comprising:

forming a measured bundle of uniformly closely packed nonwoven, generally parallel discrete filaments;

supporting a cup element;

placing a measured amount of instant adhesive in the bottom interior of said cup element so that a thin layer of such adhesive completely covers the bottom of the interior surface of the cup element;

promptly driving such bundle into the cup element so that all of the filaments at one end of the bundle are in contact with the adhesive, prior to the curing of the adhesive; and curing the adhesive whereby the one end face of the bundle is secured to the bottom of the interior of the cup element.

42. A method of honing a workpiece having a bore surrounded by an internal wall comprising the steps of:

securing a honing tool, which includes a cup element having a bottom interior surface, a bundle of closely packed discrete generally parallel filaments secured in the cup element, and a thin layer of instant adhesive securing substantially all the filaments at one end face of the bundle to the bottom interior surface of the cup element, to a honing machine;

inserting the honing machine into the bore;

feeding the honing tool progressively outwardly into engagement with the wall at a selected honing pressure; and rotating said honing machine whereby the honing tool abrades and finishes the wall.

43. A method as set forth in claim 42 further including the step of reciprocating the honing machine along the axial length of the bore.

* * * * *